US006336870B1

(12) United States Patent
Kato et al.

(10) Patent No.: US 6,336,870 B1
(45) Date of Patent: Jan. 8, 2002

(54) GOLF BALL

(75) Inventors: Naoki Kato, Fukuchiyama; Satoshi Iwami, Hyogo-ken; Kuniyasu Horiuchi, Kobe, all of (JP)

(73) Assignee: Sumitomo Rubber Industries, Hyogo-ken (JP)

( * ) Notice: Subject to any disclaimer, the term of this patent is extended or adjusted under 35 U.S.C. 154(b) by 0 days.

(21) Appl. No.: 09/240,574

(22) Filed: Feb. 1, 1999

(30) Foreign Application Priority Data

Feb. 3, 1998 (JP) ..... 10-021877

(51) Int. Cl.[7] ..... A63B 37/00
(52) U.S. Cl. ..... 473/351; 473/356; 473/359
(58) Field of Search ..... 473/351, 359, 473/363, 365, 373, 377, 385; 524/84, 95, 908; 273/235 R, 235 A, 220

(56) References Cited

U.S. PATENT DOCUMENTS 4,679,794 A 7/1987 Yamada et al.
5,150,906 A * 9/1992 Molitor et al. ..... 273/220
5,156,405 A * 10/1992 Kitoah ..... 273/235
5,409,974 A 4/1995 Sullivan et al.
5,730,663 A * 3/1998 Tanaka ..... 473/373
5,833,552 A * 11/1998 Hamada ..... 473/359

FOREIGN PATENT DOCUMENTS

| | | |
|---|---|---|
| EP | 632112 A3 | 4/1995 |
| EP | 632112 A2 | 4/1995 |
| EP | 632113 A2 | 4/1995 |
| GB | 21 4445 A | 2/1985 |

* cited by examiner

*Primary Examiner*—Lee Young
*Assistant Examiner*—Sean Smith

(57) ABSTRACT

The present invention provides a golf ball having high whiteness and having good appearance without using white paint. The present invention relates to a golf ball comprising a core and a cover formed on the core, wherein the cover contains 1 to 7 parts by weight of titanium dioxide, 0.001 to 0.5 parts by weight of blue pigment and 0.00001 to 0.005 parts by weight of red pigment, based on 100 parts by weight of ionomer resin, at a weight ratio of the blue pigment to the red pigment of 99.99/0.01 to 95/5.

5 Claims, No Drawings

GOLF BALL

FIELD OF THE INVENTION

The present invention relates to a golf ball. More particularly, it relates to a thread wound golf ball and a two-piece solid golf ball, of which a cover is formed from thermoplastic resin, such as ionomer resin.

BACKGROUND OF THE INVENTION

Hitherto, there have been available thread wound golf balls or two-piece solid golf balls, of which a cover is formed from thermoplastic resin such as ionomer resin. In order to make the golf ball whiter, the cover contains white pigment such as titanium dioxide. However, since the white pigment does not impart sufficient whiteness to the golf balls, the whited cover is further coated with white paint.

When a surface of the golf ball is damaged at the time of hitting by an iron club and its paint layer is peeled off, the appearance of the golf ball is poor because of exposure of underlayer (cover layer). There are golf balls having only paint layer but no white paint layer. However, the whiteness of the cover is poor, and thus the appearance of the golf ball is interior to those having white paint layer.

OBJECTS OF THE INVENTION

A main object of the present invention is to provide a golf ball having high whiteness and having good appearance without using white paint.

According to the present invention, the object described above has been accomplished by employing a cover composition containing a specified amount of titanium dioxide, blue pigment and red pigment, based on 100 parts by weight of ionomer resin, thereby providing a golf ball having high whiteness and having good appearance without using white paint.

SUMMARY OF THE INVENTION

The present invention provides a golf ball comprising a core and a cover formed on the core, wherein the cover contains 1 to 7 parts by weight of titanium dioxide, 0.001 to 0.5 parts by weight of blue pigment and 0.00001 to 0.005 parts by weight of red pigment, based on 100 parts by weight of ionomer resin, at a weight ratio of the blue pigment to the red pigment of 99.99/0.01 to 95/5.

DETAILED DESCRIPTION OF THE INVENTION

The golf ball of the present invention will be explained hereinafter. The golf ball of the present invention is composed of a core and a cover formed on the core. The golf ball of the present invention may be either solid golf ball such as two-piece solid golf ball o r thread wound golf ball. The core for solid golf ball (solid core) may be the same one that has been conventionally used, and may be obtained by mixing a rubber composition using a mixer such as a mixing roll, and then vulcanizing (crosslinking) or press-molding the mixture in a given mold into a spherical form. The rubber composition comprises a base rubber such as polybutadiene rubber, a metal salt of α,β-unsaturated carboxylic acid, an organic peroxide as a co-crosslinking initiator, zinc oxide, optionally filler and the like.

The core for thread wound golf ball (thread wound core) comprises a center and a thread rubber layer formed by winding thread rubber in a stretched state around the center.

The center may be either liquid center or solid center. The thread rubber can be the same one that has been conventionally used. The thread rubber can be obtained by vulcanizing a rubber composition prepared by formulating sulfur, a vulcanization aid, a vulcanization accelerator, an antioxidant and the like to natural rubber or a blend of natural rubber and a synthetic polyisoprene. The examples of solid core and thread wound core are only for purpose of illustration, and are not to be construed to limit thereto.

In the golf ball of the present invention, the core is covered with a cover. The cover may have single layer structure or multi-layer structure that has two or more layers. The cover of the golf ball of the present invention is preferably formed from ionomer resin or a mixture thereof. The ionomer resin may be a copolymer of α-olefin and α,β-unsaturated carboxylic acid having 3 to 8 carbon atoms, of which a portion of carboxylic acid groups is neutralized with metal ion. Examples of the α-olefins in the ionomer preferably include ethylene, propylene and the like. Examples of the α,β-unsaturated carboxylic acid in the ionomer preferably include acrylic acid, methacrylic acid and the like. The metal ion which neutralizes a portion of carboxylic acid groups of the copolymer includes alkali metal ion, such as sodium ion, potassium ion, lithium ion and the like; divalent metal ion, such as zinc ion, calcium ion, magnesium ion, and the like; trivalent metal ion, such as aluminum ion and the like; and the mixture thereof. Preferred are sodium ion, zinc ion, lithium ion and the like, in view of rebound characteristics, durability and the like. The ionomer resin is not limited, but examples thereof will be shown by a trade name thereof. Examples of the ionomer resins, which are commercially available from Du Pont Co., include Surlyn 1605, Surlyn 1706, Surlyn 1707, Surlyn AD8541 and Surlyn AD8542. Examples of the ionomer resins, which are commercially available from Mitsui Du Pont Polychemical Co., Ltd. include Hi-milan 1557, Hi-milan 1605, Hi-milan 1652, Hi-milan 1705, Hi-milan 1706, Hi-milan 1707, Hi-milan 1855 and Hi-milan 1856. Examples of the ionomer resins, which are commercially available from Exxon Chemical Co., include Iotek 7010, Iotek 8000 and the like. These ionomer resins may be used alone or in combination. The cover composition used in the present invention may optionally contain the other resin component, such as nylon, polyester, polyurethane and the like, in addition to the ionomer resin. If used, an amount of the resin component is preferably up to 20 parts by weight, based on 100 parts by weight of the ionomer resin.

Titanium dioxide used in the cover of the present invention may be either rutile type or anatase type. An amount of the titanium dioxide is 1 to 7 parts by weight, preferably 2 to 6 parts by weight, based on 100 parts by weight of the ionomer resin. When the amount is smaller than 1 parts by weight, the whiteness of the cover is degraded. On the other hand, when the amount is larger than 7 parts by weight, the cover is yellowish white.

Examples of the blue pigments used for the present invention are not limited thereto, but include ultramarine blue, indanthrone blue, cobalt blue, fast sky blue, phthalocyanine blue, dark blue (Prussian blue) and the like. An amount of the blue pigment is 0.001 to 0.5 parts by weight, preferably 0.01 to 0.4 parts by weight, based on 100 parts by weight of the ionomer resin. When the amount of the blue pigment is smaller than 0.001 parts by weight, the cover is yellowish white. On the other hand, when the amount of the blue pigment is larger than 0.5 parts by weight, the cover is bluish white.

Examples of the red pigments used for the present invention are not limited thereto, but include quinacridone red, permanent red and the like. An amount of the red pigment is 0.00001 to 0.005 parts by weight, preferably 0.0001 to 0.04 parts by weight, based on 100 parts by weight of the ionomer resin. When the amount of the blue pigment is smaller than 0.00001 parts by weight, the cover is yellowish white. On the other hand, when the amount of the red pigment is larger than 0.005 parts by weight, the cover is reddish white. When a weight ratio of the blue pigment to the red pigment is out of the range of 99.99/0.01 to 95/5, whiteness of the cover is not sufficient.

The cover composition used in the present invention may optionally contain fillers (such as barium sulfate, etc.) and the other additives such as a dispersant, an antioxidant, a UV absorber, a photostabilizer and a fluorescent agent or a fluorescent brightener, etc., in addition to the above components, as long as the addition of the additives does not deteriorate the desired performance of the golf ball cover.

The cover used in the present invention can be formed by a conventional method for forming golf ball cover well known in the art. The method is not specifically limited. For example, there can be used a method comprising the steps of molding the cover composition into a semi-spherical half-shell in advance, covering a core with the two half-shells, followed by pressure molding at 130 to 170° C. for 1 to 5 minutes, or a method comprising injection molding the cover composition directly on the core to cover it. The cover has a thickness of 1 to 3 mm, preferably 1.5 to 2.5 mm. When the thickness is smaller than 1 mm, spin amount is larger, and thus flight performance is degraded. On the other hand, when the thickness is larger than 3 mm, shot feel at the time of hitting is hard, heavy and poor.

At the time of cover molding, many depressions called "dimples" may be optionally formed on the surface of the golf ball. Furthermore, paint finishing or marking stamp may be optionally provided after cover molding for serving commercial sell.

In the present invention, the paint finishing may be conducted by coating one or more layers of clear coating on the cover layer with clear paint. The clear paint is a weather-resistant non-yellowing urethane paint, of which whiteness and weather-resistance can be improved by addition of a fluorescent brightener or a UV absorber.

In the present invention, the marking may be conducted by printing a mark directly on the cover layer, and then coating one or more layers of clear coating on the print, or by coating one or more layers of clear coating on the cover layer, printing a mark on the clear coating, and then coating one or more layers of clear coating on the print.

EXAMPLES

The following Examples and Comparative Examples further illustrate the present invention in detail but are not to be construed to limit the scope of the present invention thereto.

Production of Cores

The core rubber compositions having formulation shown in Table 1 were mixed and then vulcanized or press-molded in a mold to obtain spherical cores having a diameter of 38.5 mm. The vulcanization was conducted at 150° C. for 35 minutes.

TABLE 1

| Core composition | Amount (parts by weight) |
|---|---|
| Polybutadiene | 100 |
| Zinc acrylate | 30 |
| Zinc oxide | 19 |
| Antioxidant | 0.5 |
| Dicumyl peroxide | 2.0 |

Examples 1 to 5 and Comparative Examples 1 to 3

A cover layer was formed by directly injection molding the cover composition having formulation shown in Table 2 (Examples) and Table 3 (Comparative Examples) on the core obtained above. Then, paint shown in the same Table was applied on the surface to produce a large size golf ball having a diameter of 42.7 cm. The appearance of the resulting golf balls before and after chunking were evaluated. The results are shown in Table 4. The test methods are described later.

TABLE 2

(parts by weight)

| | Example No. | | | | |
|---|---|---|---|---|---|
| | 1 | 2 | 3 | 4 | 5 |
| Surlyn 1605 *1 | 50 | 50 | 50 | 50 | 50 |
| Surlyn 1706 *2 | 50 | 50 | 50 | 50 | 50 |
| Titanium dioxide | 2 | 3 | 3 | 3 | 3 |
| Barium sulfate | 2 | 1 | 1 | 1 | 1 |
| Blue pigment *3 | 0.02 | 0.02 | 0.02 | 0.03 | 0.03 |
| Red pigment *4 | 0.0004 | 0.0002 | 0.0001 | 0.0002 | 0.0001 |
| Weight ratio of pigment (blue/red) | 98.04/1.96 | 99.01/0.99 | 99.50/0.50 | 99.34/0.66 | 99.67/0.33 |
| Type of paint | Clear | Clear | Clear | Clear | Clear |

TABLE 3

| Comparative Example No. | (parts by weight) 1 | 2 | 3 |
|---|---|---|---|
| Surlyn 1605 *1 | 50 | 50 | 50 |
| Surlyn 1706 *2 | 50 | 50 | 50 |
| Titanium dioxide | 3 | 3 | 2 |
| Barium sulfate | 1 | 1 | 2 |
| Blue pigment *3 | 0.02 | 0.02 | 0.02 |
| Red pigment *4 | 0.004 | — | — |
| Weight ratio of pigment(blue/red) | 83.33/16.67 | 100/0 | 100/0 |
| Type of paint | Clear | Clear | White enamel/ Clear |

Test Method (1)Appearance

The appearance of the resulting golf ball was evaluated by using a color-difference-colorimeter manufactured by Minolta Camera Co., Ltd. and by visual observation. The evaluation criteria are as follows.

(Evaluation criteria)

◎: Very good

○: Good

Δ: Fairly good

X: Poor (2)Appearance after chunking

After a pitching wedge was mounted to a swing robot manufactured by True Temper Co. and a golf ball was top-hit at a head speed of 30 m/second, the appearance after chunking was determined by evaluating it by the same manner as described above.

Test Result

TABLE 4

| | Example No. | | | | | Comparative Example No. | | |
|---|---|---|---|---|---|---|---|---|
| Test item | 1 | 2 | 3 | 4 | 5 | 1 | 2 | 3 |
| Appearance | ○ | ○ | ○~◎ | ◎ | ◎ | X | X | ○ |
| Appearance after chunking | ○ | ○ | ◎ | ◎ | ◎ | X | X | X |

As is apparent from the results in Table 4, the golf balls of Examples 1 to 5 containing blue pigment and red pigment in the cover at the specified weight ratio of the blue pigment to the red pigment have better appearance and appearance after chunking than the golf ball of Comparative Example 1 containing the pigments in the cover out of the weight ratio and the golf ball of Comparative Example 2 only containing the blue pigment. The golf balls of Examples 1 to 5 have appearance equal to or better than the golf ball of Comparative Example 3 having the cover only containing the blue pigment and comprising coating paint containing white paint. But the golf balls of Examples 1 to 5 have much better appearance after chunking than the golf ball of Comparative Example 3.

What is claimed is:

1. A golf ball comprising a core and a cover formed on the core, wherein the cover contains 1 to 7 parts by weight of titanium dioxide, 0.001 to 0.5 parts by weight of blue pigment and 0.00001 to 0.005 parts by weight of red pigment, based on 100 parts by weight of ionomer resin, at a weight ratio of the blue pigment to the red pigment of 99.99/0.01 to 95/5.

2. The golf ball according to claim 1, wherein the cover is coated with one or more layers of clear coating.

3. The golf ball according to claim 2, wherein the clear coating is urethane clear coating.

4. The golf ball according to claim 1, wherein the cover is printed with marks and then coated with clear paint once or more.

5. The golf ball according to claim 1, wherein the cover is coated with clear paint, and then printed with marks, followed by coating with clear paint.

* * * * *